US007225881B1

(12) United States Patent
Bushnell

(10) Patent No.: US 7,225,881 B1
(45) Date of Patent: Jun. 5, 2007

(54) PASSIVE LOGGING SONDE AUGER TOOL

(76) Inventor: David C. Bushnell, 7324 Larchview Dr., Dallas, TX (US) 75254

( * ) Notice: Subject to any disclaimer, the term of this patent is extended or adjusted under 35 U.S.C. 154(b) by 164 days.

(21) Appl. No.: 11/145,870

(22) Filed: Jun. 6, 2005

(51) Int. Cl.
*E21B 17/22* (2006.01)
*E21B 47/01* (2006.01)

(52) U.S. Cl. ..... 166/385; 166/241.5; 175/320; 175/323

(58) Field of Classification Search ..... 166/385, 166/241.5; 175/320, 323, 50
See application file for complete search history.

(56) References Cited

U.S. PATENT DOCUMENTS 1,276,706 A 8/1918 Aydelotte
1,303,764 A 5/1919 Broadway
1,372,318 A 3/1921 Salinger
1,388,545 A 8/1921 Bohan
2,216,656 A 10/1940 Smythe
2,712,697 A * 7/1955 Lebourg ..... 33/544.3
3,060,588 A * 10/1962 Lanmon, II et al. ..... 33/544.3
3,323,326 A * 6/1967 Vertson ..... 464/20
3,375,885 A 4/1968 Scott
3,710,877 A 1/1973 Michasiw
4,270,620 A 6/1981 Lawrence
4,422,043 A 12/1983 Meador
4,676,310 A 6/1987 Scherbatskoy
4,771,830 A 9/1988 Peate
4,901,806 A * 2/1990 Forrest ..... 175/321
4,912,415 A 3/1990 Sorensen
5,259,467 A 11/1993 Schoeffler
5,396,966 A 3/1995 Roos, Jr.
5,994,904 A * 11/1999 Eslambolchi et al. ..... 324/326
6,585,062 B2 * 7/2003 Rozendaal et al. ..... 175/53
6,681,871 B2 1/2004 Drumm
7,086,808 B2 * 8/2006 Wentworth et al. ..... 405/184
2004/0129457 A1 7/2004 McNeilly

* cited by examiner

*Primary Examiner*—Jennifer H. Gay
*Assistant Examiner*—Shane Bomar

(57) ABSTRACT

The auger is attached to a spiral gear and a spring, the apparatus then being connected to the downhole, leading end of the logging sonde. When the auger nose of the modified sonde assembly strikes any of various obstructions on the sidewall that cause it to lose momentum, such as a rock ledge, the momentum of the heavy sonde causes the auger nose assembly to compress, forcing the auger to rotate on the spiral gear. The rotational action thus produced allows the auger to pull the sonde to pass the obstruction. After the obstruction has been passed, the potential energy stored in the spring induces the auger to return to its original extended position, whereupon it is ready to encounter and pass another obstacle.

10 Claims, 7 Drawing Sheets

PASSIVE LOGGING SONDE AUGER TOOL

CROSS-REFERENCES TO RELATED APPLICATIONS

Not Applicable

FEDERALLY SPONSORED RESEARCH

Not Applicable

SEQUENCE LISTING OF PROGRAM

Not Applicable

BACKGROUND OF THE INVENTION—FIELD OF INVENTION

This invention relates to acquiring rock data in oil and gas wells, specifically to the mechanics of running the measuring instruments past sidewall obstructions to the bottom of the well during the logging operation.

BACKGROUND OF THE INVENTION—SUMMARY OF THE PROBLEM TO BE SOLVED BY THE PRESENT INVENTION

The measurement, or logging, of rock properties in wells drilled for hydrocarbons has become an increasingly essential part of petroleum exploration since the first downhole wireline electrical log was invented by Schlumberger in 1939. Paper data strips (or digital data displays), referred to as well logs, now constitute the main record of the rock formations penetrated by oil and gas wells. But throughout the 65-year history of electrical logging, obstructions on the borehole sidewall have caused difficulties in running logging sondes down the hole. Logging sondes comprise various sets of instruments that can be lowered into the borehole on an electrical cable, with the data thereby recorded at the surface. A problem that has never been completely solved is that of reliably getting the sonde to run in all the way to the bottom of the well.

As modem boreholes become deviated farther and farther from vertical, this problem is exacerbated. Instead of dropping freely down the center of the borehole, the logging sonde then tends to slide along the lower sidewall of the borehole. In this position, the sonde is slowed by friction or stopped by minor sidewall obstructions. Once the considerable down-hole momentum of the sonde has been lessened or lost, it becomes difficult to urge the sonde to pass even minor obstructions or sidewall roughness.

Despite the use of the many previous inventions for urging the logging sonde past borehole obstructions, it often happens that the borehole must be repeatedly reconditioned with the drilling bit, a time-consuming and costly remedy. In the worst cases, the logging sonde never reaches the lower part of the borehole, and that part of the hole does not get logged. In petroleum exploration and production drilling, it is usually the bottom part of the hole that is most important, as that is where the potential petroleum producing zones often lie. Failure to log these potentially producing zones may lead to inaccurate assessment of the potential producing zones or even the premature abandonment of an expensive borehole that might have become a profitable oil or gas well. In addition to the financial loss is the potential loss of valuable resources.

BACKGROUND OF THE INVENTION—PRIOR ART

In the petroleum drilling industry, determining the characteristics of the rock formations that have been drilled has been of critical importance since the birth of the industry over a hundred years ago. Since the 1940s, increasingly sophisticated rock measurements have been made by lowering logging sondes into the borehole or producing well. The logging sondes are suspended from the surface by an electrical cable that normally allows the recording of the information at the surface.

Prior Art

Since the inception of the well logging industry, various devices have been employed to ease the running in hole of the logging sondes. These devices have been partly successful, but as wells become deeper and the well angles become farther from the vertical, the difficulty of logging has increased apace. Consequently, sondes still frequently fail to reach bottom. However, none of the prior art bears much resemblance to the present invention and therefore they will be discussed mainly to highlight the differences.

One attempt to a solution that is still used is a tractor device, wherein a tiny tracked vehicle with an electric motor is attached to the sonde and is employed to pull the sonde along. However, the tractor can only be used when the sonde has come to a stop or nearly so. A related solution to the problem of running in hole involves small wheels, pressed against the sidewall and powered by motors in the sonde. These approaches have been patented, but they are unrelated to my invention and so will not be discussed further.

Pushing the sonde down the borehole with the drill pipe is another method currently in use, especially in boreholes with high deviation. This method has the disadvantages of being very slow, as running drill pipe in the borehole is an inherently slow process, and of potentially damaging or destroying the sonde and the logging cable. Damaging the logging equipment leads to long delays in the logging operation for repairs. Often the specific logging operation must be abandoned for lack of available replacement tools. Destruction of the logging sonde may leave junk in the borehole, leading to lost time in the retrieval of the junk or drilling past the junk in a parallel borehole.

An increasingly popular solution is to incorporate the logging sensors into the drilling assembly, wherein information is relayed to the surface acoustically via pulses in the drilling mud. The process is called measurement-while-drilling, or MWD. This is at best an imperfect solution and is limited to certain kinds of logs. However, the technology is utilized in some of the prior art discussed below.

Previous Patents

Several auger-like tools were found among prior patents, mainly war machines and hole-digging tools. None closely resemble the current invention beyond the novel use of an augering tool, itself an ancient device. They are described briefly below to demonstrate the evolution of auger tool patents:

(1) Auger. Perhaps it should be mentioned that my invention, in common with several of the patented inventions described below, makes some use of the auger, an ancient tool. The auger is fundamentally a coiled version of an inclined plane, or a screw. The auger dates at least as far back as the ancient Greek Empire, and probably much earlier. It was employed by Archimedes some 2200 years ago as the water-pumping device now known by his name, the Archimedes Screw. However, my invention introduces a new and unanticipated use of this basic tool.

(2) Push screw driver. The present invention employs a helical gear in somewhat the same manner as the old push screw driver, in which the rotation of the blade is activated by pushing the handle.

(3) U.S. Pat. No. 1,276,706—Issued August, 1918 to Mr. Gurdy L. Aydelotte. Land Torpedo. This ground torpedo appears to be a clever war machine developed to burrow in mud, soil or soft alluvium. It is powered by an electric motor energized by a trailing electric cable that is connected to a power source at the ground surface or possibly a trench. It is designed to carry a bomb that can be detonated by the operator.

Aydelotte's patented device has little in common with the current invention. Aydelotte's land torpedo is electrically powered, whereas my passive logging sonde auger derives its energy from the momentum of the logging sonde. Aydelotte's land torpedo is designed to progress by boring its way continuously through the soil in a generally horizontal direction, whereas my passive logging sonde auger is designed to operate occasionally in an open borehole in a generally downward direction. Neither the passive nature nor the spring return of my passive logging sonde auger is anticipated by Aydelotte's land torpedo, and these two features are the main mechanical innovations of my invention.

(4) U.S. Pat. No. 1,303,764—Issued May, 1919, to Mr. Prentice C. Broadway. Armored War Apparatus. This war apparatus is an innovative battle tank that uses an auger device on both the front and back ends to aid the tank in penetrating forests and walls. (An application not specifically mentioned, and apparently never used, might have been to aid the tanks in penetrating dense hedges such as those encountered in the Normandy invasion during World War II.)

Broadway's patented armored war apparatus has little in common with the current invention. Broadway's war apparatus is designed to be actively powered, whereas my passive logging sonde auger derives its energy only from the momentum of the logging sonde to which it is attached. Broadway's war apparatus is designed for use above ground in a generally horizontal direction to penetrate obstacles, whereas my passive logging sonde auger is designed to operate in an open borehole in a generally downward direction and to bypass obstacles. Most importantly, Broadway's war apparatus anticipates neither the passive nature nor the spring return of my passive logging sonde auger, and these two features are the main mechanical innovations of my invention.

(5) U.S. Pat. No. 1,372,318—Issued Mar. 22, 1921, to Mr. Alois B. Saliger and assigned to Saliger Ship Salvage Corporation. Burrowing Machine. Like Aydelotte's land torpedo (U.S. Pat. No. 1,276,706), Saliger's burrowing machine is a device for burrowing semi-horizontally through soft material, in this case mud. It was invented to draw a line under a sunken ship to aid in its salvage. Also like the land torpedo, Saliger's burrowing machine employs auger-like attachments for this purpose, termed propellers in the patent description. The burrowing machine is to be powered by an included fluid hydraulic motor, either gas or liquid, with a pump at the surface. An electric motor is suggested as an alternative power source.

Saliger's patented device has little in common with the current invention. Saliger's burrowing machine requires a hydraulic or electrical power source, whereas my passive logging sonde auger derives its energy from the momentum of the logging sonde. Saliger's burrowing machine is designed to progress by boring its way continuously through the mud in a generally horizontal direction, whereas my passive logging sonde auger is designed to operate only as needed in an open borehole in a generally downward direction. Neither the passive nature nor the spring return of my passive logging sonde auger is anticipated by Saliger's burrowing machine, and these two features are the main mechanical innovations of my invention.

(6) U.S. Pat. No. 1,388,545—Issued Aug. 23, 1921, to William J. Bohan. Self-intrenching Subsurface Land-Torpedo. This ground torpedo appears to be a sophisticated version of Aydelotte's land torpedo (U.S. Pat. No. 1,276,706). It is also powered by an electric motor and energized by a trailing electric cable that is connected to a power source at the ground surface, in this case a personnel trench. Like Aydelotte's land torpedo, it is designed to carry a bomb that can be detonated by the operator by means of an electrical signal transmitted along the trailing electrical cable.

Bohan's patented device has little in common with the current invention. Bohan's self-intrenching land torpedo is electrically powered, whereas my passive logging sonde auger derives its energy from the inertia of the logging sonde. Bohan's land torpedo is designed to progress by boring its way continuously through the soil in a generally horizontal direction, whereas my passive logging sonde auger is designed to operate only as needed in an open borehole in a generally downward direction. Neither the passive nature nor the spring return of my passive logging sonde auger is anticipated by Aydelotte's land torpedo, and these two features are the main mechanical innovations of my invention.

(7) U.S. Pat. No. 2,216,656—Issued Oct. 1, 1940, to Roy Smythe and partly assigned to Angelo J. Giannone. Toy. Smythe's invention is basically a clever toy version of the war machines described above, employing a windup motor as a power source. Aside from the novel power source, Smythe's toy contributes nothing to the technology of augering tools. Like the inventions upon which it is based, it in no way anticipates my passive logging sonde auger.

(8) U.S. Pat. No. 3,375,885—Issued Apr. 2, 1968, to R. F. Scott, et al. Burrowing Mechanism. Scott's invention is basically an industrial version of the clever toy of Smythe (U.S. Pat. No. 2,216,656). Like other inventions described above, it uses an electrical motor as a power source. Each of the basic elements were covered in the patents described above, and Scott's burrowing machine contributes nothing to the technology of augering tools. Like the inventions upon which it is based, it in no way anticipates my passive logging sonde auger.

(9) U.S. Pat. No. 3,710,877—Issued Jan. 16, 1973, to Harry Michasiw. Auger Device. This patent describes one of what must be many augering devices designed for digging holes, particularly for posts. The device combines an auger, a shaft, and a power source. The power source in the generic digging auger may be manual, hydraulic, or machine.

(10) U.S. Pat. No. 6,691,871—Issued Jan. 24, 2004, to Arthur E. Drumm and Thomas B. Mash. Auger tool for boring. Drumm's auger patent illustrates 31 years of progress in digging auger design since the issuing of the Auger Device patent to Harry Michasiw, above. Neither Drumm's patent, his prior art patent documents (U.S. Pat. Nos. 1,993,365, 2,221,680, 3,710,877, 5,487,432, 5,782,310, 6,089,334), nor patents referenced in the prior art (U.S. Pat. Nos. 6,161,631, 6,168,350, 6,283,321, 6,308,789, 6,675,916) provide material that anticipates my passive logging sonde auger.

The augering devices described above have little in common with my invention. Each is externally powered, whether by hand or by machine, whereas my passive logging sonde auger derives its energy from the inertia of a logging sonde. Neither the passive nature nor the automatic re-extension of my passive logging sonde auger is anticipated in the augers designed for digging holes. These two features are the main mechanical innovations of my invention.

The following items of patented prior art all relate specifically to drilling devices or measurement devices used in the oil and gas drilling industry:

(11) U.S. Pat. No. 4,270,620—Issued Jun. 2, 1981, to Mr. James D. Lawrence. Constant Bottom Contact Tool. Lawrence's invention pertains to maintaining constant bottom contact with a borehole bit during drilling operations, especially those conducted at sea. This field of invention is unrelated to my invention, which pertains to the lowering of a measuring sonde into a well bore.

In Lawrence's Constant Bottom Contact Tool, a spring and helical gear within the bottom hole drilling assembly function as a shock absorber, both for unavoidable vertical motion of the drilling assembly and for sudden changes in torque on the drill bit. The intent is to reduce vertical and torsional loads on the drill string without substantially interfering with normal drilling operations. In doing so, the entire drill pipe and drilling assembly suffers less stress that might otherwise cause it to break.

In contrast, my invention employs a helical gear and spring assembly in a measuring sonde to convert some on the kinetic energy of the sonde to rotational energy in the auger, thus causing the auger to rotate in a manner that pulls the sonde past the obstruction that caused the assembly to be activated. Thus even though Lawrence's and my inventions utilize similar mechanical elements, my invention uses these elements in a totally different manner so as to achieve a different and unrelated result.

(12) U.S. Pat. No. 4,422,043—Issued Dec. 20, 1983 to Mr. Richard A. Meador. Electromagnetic Wave Logging Dipmeter. Meador's invention pertains to an improvement in the dipmeter measuring sonde. My invention pertains to lowering measuring sondes into boreholes and is therefore unrelated in purpose.

In Meador's invention, a longitudinal spring is employed to provide force to extend measuring pads laterally to contact the sidewalls of the borehole. This is a common use of longitudinal springs in many modern logging devices. My invention uses a longitudinal spring in a contrasting manner as a means of resistance and to re-extend an augering tool to its initial position after pulling the attached sonde past an obstruction. Thus the use of a longitudinal spring in my invention bears no similarity the use in Meador's invention or to similar patented measuring sondes with pad-mounted sensors.

(13) U.S. Pat. No. 4,912,415—Issued to Kurt I. Sorensen on Mar. 27, 1990. Sonde of Electrodes on an Earth Drill for Measuring the Electric Formation Resistivity in Earth Strata. The field of Sorensen's invention pertains to measuring instruments that are incorporated into a drilling assembly, for logging during the drilling operation. It is an attempt to improve on the relatively new MWD (measurement while drilling) technology that is now in wide use in high-angle wells. My invention pertains to lowering measuring sondes into boreholes and is therefore unrelated in operational function.

Sorensen's invention makes use of a spiral winding to aid in the removal of drill cuttings from the vicinity of the MWD sonde. The spiral winding does not engage any other part of the mechanism and therefore does not function as a gear. The tool's function as an auger is limited to moving material up the borehole; it plays no part in the drilling operation or in the running-in-hole of the drilling and MWD assembly. In contrast, my invention employs a helical gear and spring assembly in a conventional cable-operated measuring sonde to convert some of the kinetic energy of the sonde to rotational energy in the auger, thus causing the auger to rotate in a manner that pulls the sonde past the obstruction that caused the assembly to be activated. Thus it can be seen that the spiral winding in Sorensen's invention is used in an entirely different manner than the helical gear and auger in my invention, in order to achieve a totally different end.

(14) U.S. Pat. No. 4,676,310—Issued to Mr. Serge A. Scherbatskoy and Mr. Jacob Neufeld on Jun. 30, 1987. Apparatus for Transporting measuring and/or Logging Equipment in a Borehole. Scherbatskoy and Neufeld's invention utilizes a motor-driven helix mounted on a logging sonde that can be expanded to the sidewalls, fitting then snugly in the entire diameter of the borehole. The helix is then rotated by a motor within the logging sonde, causing it to rotate in screw fashion and pull the logging sonde along. Although the helix of Scherbatskoy and Neufeld's invention can be compared to the auger of my invention, the inventions themselves are very different, in that:

(a) The auger of my invention is powered by the momentum of a rapidly moving logging sonde, whereas the helix of Scherbatskoy and Neufeld's invention is powered by a motor in a stationary or near-stationary logging sonde.

(b) The auger of my invention is designed to be an extension of the logging sonde and of similar diameter, whereas the helix of Scherbatskoy and Neufeld's invention is designed to be mechanically forced into the entire diameter of the sidewall, (c) The purpose of my invention is to keep the logging sonde moving down the borehole and maintain its momentum, whereas Scherbatskoy and Neufeld's invention has the purpose of pulling a logging sonde that has already become stuck or has otherwise lost its downward momentum.

(15) U.S. Pat. No. 4,771,830—Issued to Mr. William R. Peate on Sep. 20, 1988, and assigned to Schlumberger Technology Corp. Apparatus for Positioning Well Tools in Deviated Well Bores. Like my invention, Peate's invention employs an external augering tool on a logging sonde. However, they are not mounted on the nose of the logging sonde for the running in hole operation, but on the sides of the logging sonde to aid in tool orientation during the unrelated logging out operation. Peate's drawings show that the nose of the logging sonde has been left squared off, so that the projecting ribs of his invention could not have aided in the running-in-hole operation of the logging sonde.

(16) U.S. Pat. No. 5,259,467—Issued to Mr. William N. Schoeffler on Nov. 9, 1993. Directional Drilling Tool. Schoeffler's invention pertains to the directional drilling of boreholes, more specifically to the operation of a hydraulic down-hole motor. This field of invention is unrelated to that of my invention, which pertains to the lowering of a measuring sonde into a well bore on a wireline.

Schoeffler's Directional Drilling Tool employs an internal longitudinally mounted spring to apply an upward force to a wash pipe and piston within the tool, as part of the operation of the hydraulic down-hole motor. In contrast, my invention employs a helical gear and spring assembly in a conventional cable-operated measuring sonde to convert some on the kinetic energy of a measuring sonde to rotational energy in an auger, causing the auger to rotate in a manner that pulls the sonde past the obstruction that caused the assembly to be activated. Thus it can be seen that the spring in Schoeffler's invention is used in an entirely different manner than the spring in my invention, in order to achieve a totally different end.

(17) U.S. Pat. No. 5,396,966—Issued to Mr. Albert E. Roos, Jr., Steven W. Drews, and William J. McDonald on Mar. 14, 1995. Roos, Drews, and McDonald's patent pertains to the downhole steering sub assembly for the drilling of horizontal wells for various purposes. This field of invention is unrelated that of my invention, which pertains to the lowering of a measuring sonde into a well bore on a wireline.

Roos, Drews, and McDonald's patent uses a longitudinally mounted compression spring only to provide pressure to expand bow springs that are mounted laterally on the side of the steering sub. There is no similarity to my invention in the purpose or function of the longitudinally mounted spring.

(18) patent application Publication 2004/0129457 A1—Application by Mr. Keith McNeilly dated Jul. 8, 2004. Torque Absorber for Downhole Drill Motor. The field of McNeilly's invention pertains to hydraulic down-hole motors used in the drilling of boreholes. This field of invention is unrelated to that of my invention, which pertains to the lowering of a measuring sonde into a well bore on a wireline.

McNeilly's invention uses a longitudinally mounted spring element to automatically adjust the weight on the drill bit, so as to prevent stalling of the downhole hydraulic motor due to resistance to bit rotation. In contrast, my invention employs a helical gear and spring assembly in a conventional cable-operated measuring sonde to convert some on the kinetic energy of a measuring sonde to rotational energy in an auger, thus causing the auger to rotate in a manner that pulls the sonde past the obstruction that caused the assembly to be activated. Thus it can be seen that the spring in McNeilly's invention is used in an entirely different manner than the spring in my invention, in order to achieve a totally different end.

BACKGROUND OF INVENTION—OBJECTIVES AND ADVANTAGES

The present invention introduces a unique solution to the age-old problems related to running in and logging out of oil and gas wells with logging sondes. (running in hole is the literal term used in the petroleum industry for lowering either a logging sonde or a string of drillpipe into a well. Similarly, pulling out of hole is used for the reverse operation; logging out applies to pulling the logging sonde out of the well during the logging operation with the sensors and recorders turned on. The term hole is in common use to mean either a well or a borehole. These terms are integral parts of drilling jargon and as such are incorporated in many terms.) Several objectives and advantages of the present invention are:

(a) to facilitate the running-in-hole of logging sondes, (b) to provide a means for logging sondes to bypass sidewall obstructions in boreholes, particularly washouts, boulders, ledges, keyseat grooves, and cave-ins, as illustrated in the drawings, (c) to increase the likelihood that the logging sonde will reach the bottom of the hole where the critical oil and gas reservoir data may be recorded, (d) to thereby reduce the need for repeatedly cleaning out and reconditioning the borehole with expensive and time-consuming bit runs, (e) to reduce the chances of losing the hole because of delays in the logging operation, and (f) generally, to make the borehole logging process more efficient, complete, and cost effective.

BACKGROUND OF THE INVENTION—SUMMARY

The present invention is a passive auger device that is attached to the downhole end of a borehole logging sonde in the oil and gas drilling industry. The auger device is integrated with a spring means and a spiral gear means. When, during running in a borehole, a sidewall obstruction impedes the progress of the logging sonde, downward momentum will compress the auger against the spring, and at the same time the spiral gear will cause the auger to rotate. In rotating, the auger both deflects the sonde away from the sidewall obstruction with its rotary motion and pulls it through the area of the obstruction with its auger. When the obstruction has been thus bypassed, the spring extends the auger to its initial extended position where it is then in place to encounter subsequent obstructions.

DRAWINGS

Sidewall obstructions that are commonly encountered and can be passed more easily with the benefit of the passive logging sonde auger include ledges, projecting boulders, eroded washouts, caved out zones, key seat grooves, and general sidewall roughness or rugosity. These terms are well understood in the drilling industry and are illustrated by the sketches in FIGS. 1*a* through 1*f* in order to augment understanding of the utility of the invention. When the sonde assembly is pulled out or logged out of the borehole, the passive logging sonde auger trails the sonde and is inactive.

BRIEF DESCRIPTION OF THE DRAWINGS

FIG. 2*b* is a lateral cross section of an in-gauge borehole, approximately the same diameter as the nominal drill bit size. The bit size used may vary, but is commonly between 10 cm and 50 cm in diameter in the deeper and more important part of the hole that is usually most difficult to log. In contrast, most logging sondes are around 10 cm in diameter.

FIG. 2*c* is a lateral cross section of an enlarged section of the borehole. These are common occurrences in softer rock formations. A common cause is erosion by the rotating drill pipe and the flow of drilling fluid. Enlarged sections can be very long, wide, and highly irregular.

FIG. 2*d* is a lateral cross section of a sidewall cave-in, sometimes found in faulted rock formations. They can partly block the well bore, making it difficult for logging sondes to pass, especially if they occur on the part of the sidewall along which the sonde is running.

FIG. 2*e* is a lateral cross section of boulder projecting into an enlarged section. Large boulders may also become dislodged and re-oriented so that they partly block the borehole.

FIG. 2*f* is a lateral cross section of a keyseat groove. These are usually formed because of erosion by the drill pipe in cases where it continuously lies along one side of the hole. As the drill pipe and logging sonde are of similar diameter, the sonde can enter the keyseat groove and become stuck.

FIG. 2*g* is a lateral cross section of a rock ledge in a washed out zone, a very common sidewall obstruction. Such ledges are normally composed of very hard rock. They can extend all around the hole and obstruct the sonde in any position.

FIG. 2*h* is a lateral cross section of a rough sidewall, normally found in rock formations of rapidly varying strength and resistance to erosion. Rough patches in the sidewall can slow the progress of the sonde as it runs in the hole, robbing it of important downhole velocity and kinetic energy.

FIG. 5*a* is a thick and rounded auger used in the preferred embodiment, emphasizing rounded nose and spirals.

FIG. 5*b* adds a sharp ridge on the spirals.

FIG. 5*c* is similar to the preferred embodiment of FIG. 5*a* but with a nose similar in diameter to the logging sonde.

FIG. 5*d* is a rounded, spade-shaped auger somewhat larger than the logging sonde.

FIG. 5*e* shows a thick, rounded auger with a steep pitch.

FIG. 5*f* is a more conventional auger with a deeply incised trough, commonly used in boring operations.

DRAWINGS—REFERENCE NUMERALS

Figure 1:
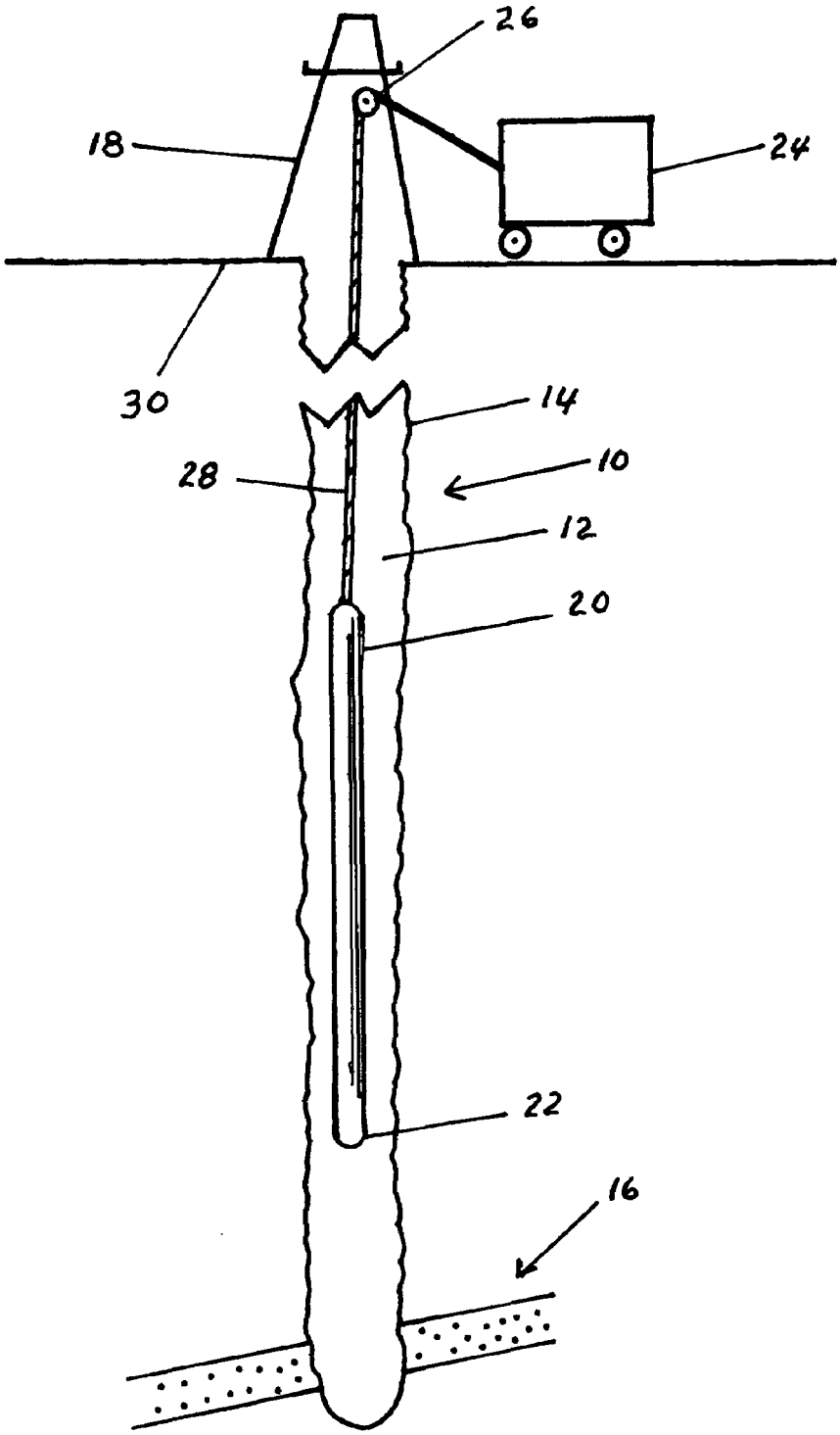
FIG. 1 PRIOR ART
FIG. 1 is a simplified diagram of a borehole in which a wireline logging operation is being conducted.

10 Earth borehole
12 Drilling fluid filling borehole
14 Sidewall of borehole
16 Oil and gas reservoir
18 Drilling rig
20 Logging sonde
22 Bull nose of logging sonde
24 Logging unit
26 Pulley
28 Logging cable
30 Surface of ground
32 Sidewall of in-gauge borehole
34 Nominal hole size, or bit diameter
36 Enlarged borehole due to erosion
38 Sidewall cave-in
40 Projecting boulder in sidewall
42 Keyseat groove
44 Ledge of hard rock
46 Rough, irregular sidewall
50 Apparatus of the present invention
52 Auger tool
54 Lower tool casing that also constitutes the exterior part of a spiral gear
55 Outside teeth of a spiral gear
56 Upper tool shaft that extends as the inside part of a spiral gear
58 Means of connection to logging sonde
60 Spring
62 Chamber
64 Inside shaft of a spiral gear
66 Mud ports
68 Safety stop
70 Logging sonde combined with the present invention as a unit
72 Cylinder portion of pneumatic device
74 Piston portion of pneumatic device
80 Sharp ridge on auger tool
82 Blunt nose on auger tool
84 Broad shoulder on auger tool
86 Steep pitch on auger tool
88 Deeply incised trough on auger tool
90 Sonde with auger tool striking a sidewall obstruction in the form of a cave-in
92 Sonde with auger tool striking a sidewall obstruction in the form of a ledge

DETAILED DESCRIPTION OF THE PREFERRED EMBODIMENT

A general view of a logging operation in which the present invention is intended to be used is shown in FIG. 1. The borehole (also referred to as the hole or well), 10 is normally in the range of 10–50 cm in diameter. Boreholes commonly decrease in diameter with depth as sections are sequentially protected behind pipe. A 30 cm diameter well is common. It is filled with viscous drilling fluid 12 during drilling operations. The wall of the open part of the hole is called the sidewall 14, and it is on the sidewall that obstructions normally are found that impede the running-in-hole of logging operations. At the surface, the drilling rig 18 and associated equipment controls virtually all of the operations in the well.

Oil and gas reservoirs 16 are normally located near the bottom of the well, which may be anywhere from 200 meters to more than 10,000 meters in depth. The fluid content of these reservoirs is assessed with wireline logs obtained in a logging operation. Based on this assessment, the borehole may be completed as a producing oil or gas well or abandoned as a dry hole.

A basic logging operation is also illustrated in FIG. 1. A logging sonde 20 with a rounded "bull nose" 22 is lowered into the borehole on a conductive logging cable 28. The logging sonde may range from 3 m to 10 m in length and may weigh as much as 100 kg. The logging cable 28 extends to the surface, where it threads through the drilling rig 18 via a pulley 26 to the logging unit 24 located on the ground surface 30 or on the deck of an offshore drilling platform or ship. This unit contains the computers, recording equipment, and human operators and is the nerve center of the logging operation. Rock formation measurements of the entire borehole are made by instruments in the logging sonde 20. The actual sensors may be centrally located in the logging sonde 20 or extended against the sidewall 14.

The present invention deals with the problem of getting the logging sonde all the way to the bottom of the borehole to log the potentially producing formations. The running-in-hole operation may be especially difficult in a deviated well, as sidewall friction is increased and the down-hole component of gravity is decreased. In such wells, the logging sonde 20 slides dwonward along the low side of the borehole where it may encounter various sidewall obstructions and irregularities that have the potential of slowing or stopping its downward progress. As the logging sonde 20 is normally around 10 cm in diameter, the center of the bull nose 22 is therefore only 5 cm from the sidewall. Consequently, its progress can be impeded by relatively small sidewall irregularities.

Figure 2A:
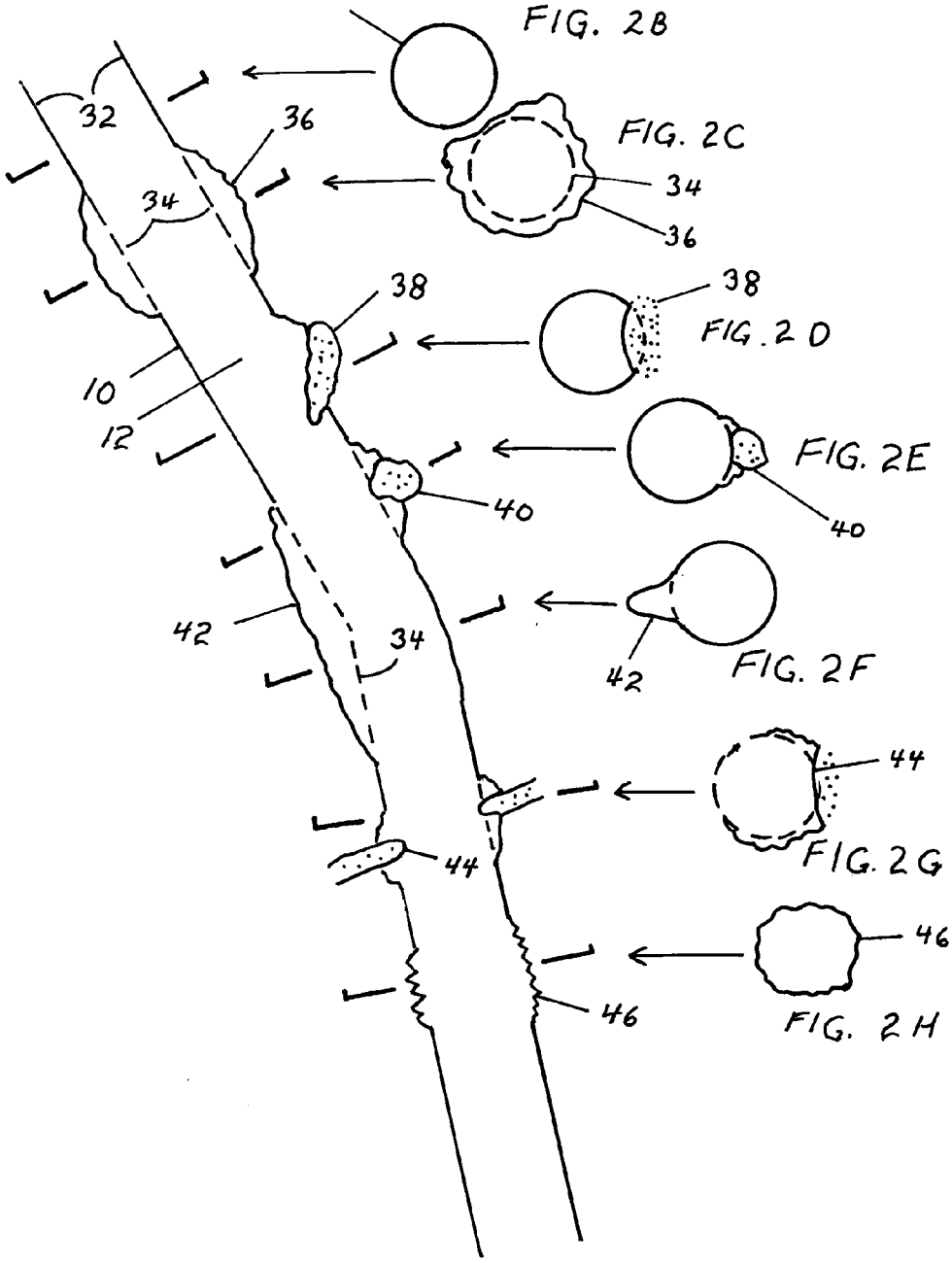
FIG. 2*a* shows a longitudinal cross section of the downhole portion of a deviated borehole in which a wireline logging operation is being conducted. It illustrates somewhat diagrammatically various sidewall obstacles to the running-in-hole of a logging sonde, that the present invention is designed to bypass. Details of the individual obstructions are discussed below with the transverse cross sections.

FIG. 2 shows some examples of sidewall irregularities, among them enlarged sections or washouts 36, cave-ins 38, boulders 40, keyseat grooves 42, ledges 44, and general sidewall roughness 46. Any of these features can cause the logging sonde to hang up, thus slowing or stopping its progress down the hole. Once the downward momentum of the logging sonde 20 has been lost, it becomes difficult or impossible to urge it to proceed. Sidewall friction prevents easily restarting the logging sonde and the original momentum cannot be regained.

Figure 3A:
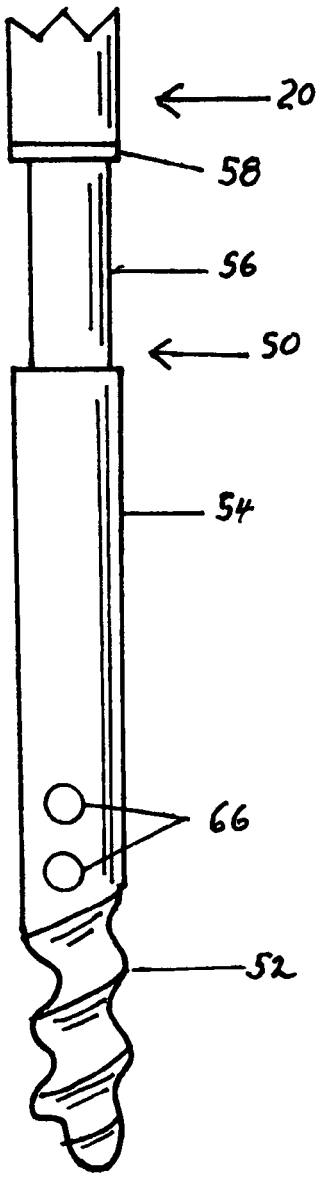
FIG. 3*a* is an exterior view of the present invention in its initial extended position, attached to the lower end of a logging sonde.
Figure 3B:
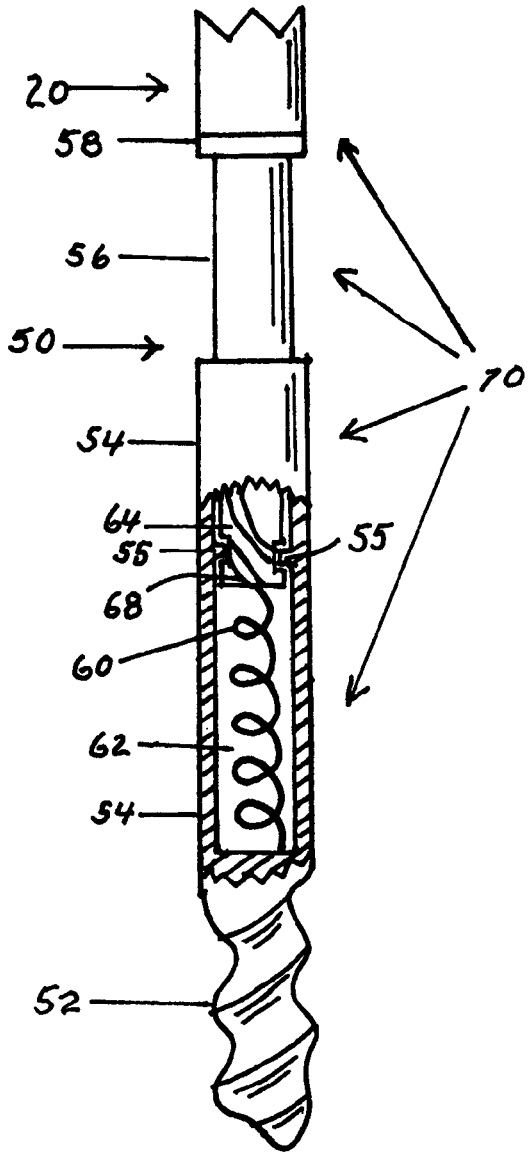
FIG. 3*b* is a cut-away view of the present invention in which the spiral gear and extended and the relaxed return spring can be seen.

The preferred embodiment of my invention replaces the standard rounded nose ("bull nose") of the logging sonde assembly 70 with a blunt-nosed augering device 50 powered by the momentum of the logging sonde. The augering device 50 comprises only a few main parts, shown and labeled in FIGS. 3A and 3B in the initial unstressed, extended position. These parts are:

(a) an auger tool 52, (b) an external tool casing 54 that is connected to the auger tool, which functions also as the external tube component of a spiral gear assembly, (c) a plurality of mud ports 66 connecting an open chamber 62 inside of the tool casing and the borehole, to allow free circulation of drilling fluid in the tool to prevent pressure buildup during compression, (d) an internal shaft component of a spiral gear assembly 64, that meshes with the external spiral gear component 55 and continues upward as a non-geared shaft 56 to a means of connection 58 with the main logging sonde 20, (e) a spring resistance mechanism 60 contained within the open chamber 62 within the lower part of the apparatus that permits the lower tool component 54 to be compressed against the spiral gear assembly 64 of the upper tool component.

The spring resistance mechanism 60 is attached at one end to the top of the auger nose 52 and on the other end to the lower end of the internal shaft of the spiral gear 64, so as to prevent the tool pulling apart. A conventional safety stop means 68 may also be placed within the spiral gear mechanism to supplement this same end.

OPERATION OF THE PREFERRED EMBODIMENT

Figure 7:
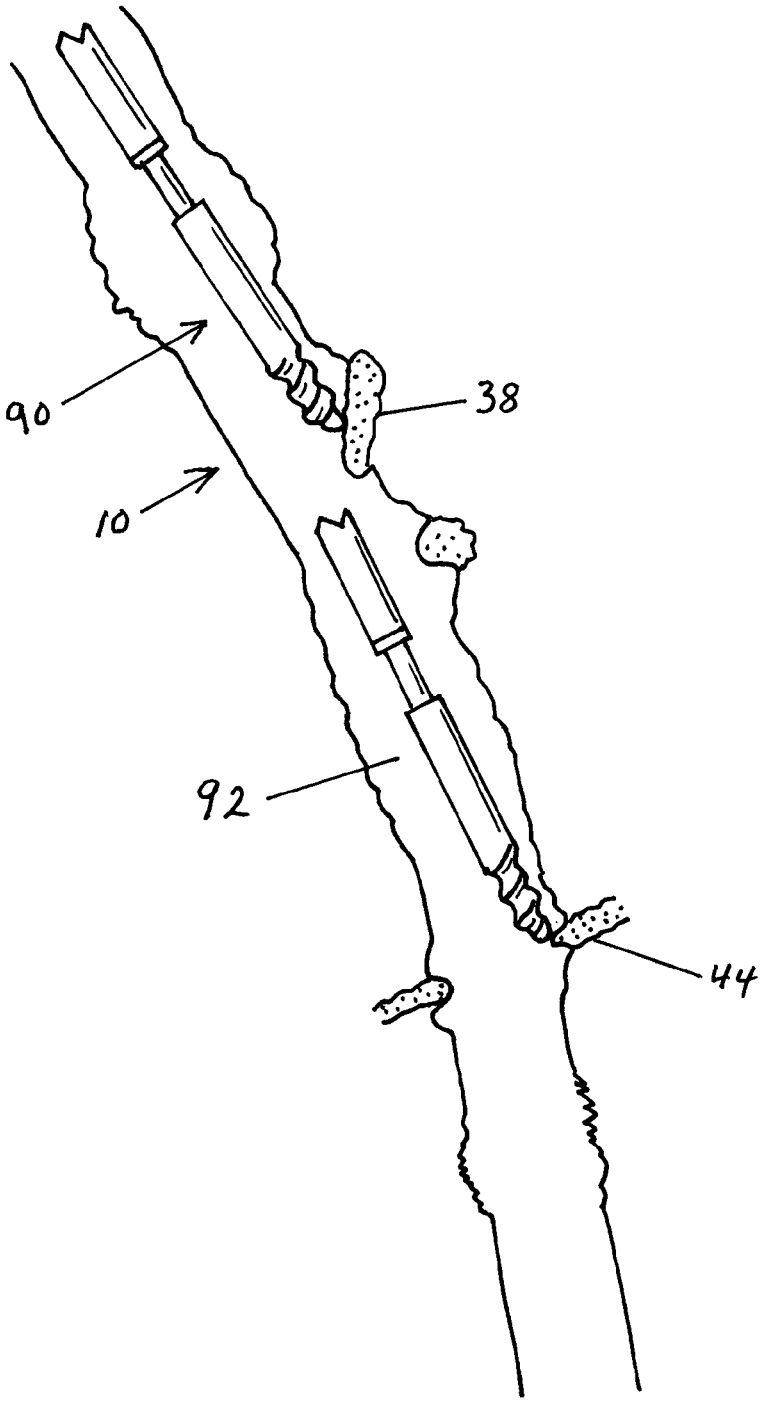
FIG. 7 shows the borehole sketch of FIG. 1*a*, in which the lower end of a logging sonde to which the present invention has been attached is shown striking two separate obstructions with the augering action set to commence.

During the making up of the logging sonde assembly in the drilling rig 18, either at the surface of the ground 30 or on a drilling vessel, the augering tool of the present invention 50 is attached at the downhole end, in place of the conventional bull nose. The logging sonde thus modified 70 is then lowered into the borehole 10 in the conventional manner, suspended by the logging cable 28. During this running-in-hole operation, the modified logging sonde 70 may strike an obstruction on the sidewall, such as a ledge cave-in 38 or a ledge 44 as illustrated in FIG. 7. When this happens, the momentum of the heavy measuring sonde 20 then forces the auger nose assembly of the present invention 52 to compress rearward against the spring 60, FIGS. 4A and 4B, so that the auger tool 52 is urged to rotate by the spiral gear 64. The augering action thereby produced allows the auger tool 52 to pull the entire sonde assembly 90 past the cave-in, ledge, or any of the other sidewall obstructions displayed in FIG. 2. In this way, sidewall obstructions that would have slowed or stopped logging sondes of older design can be bypassed with ease. Once the obstruction has been bypassed, the compressed spring resistance mechanism 60 urges the auger nose 52 to return to its original extended position FIG. 2, whereupon it is ready to encounter and bypass the next sidewall obstacle by the same process.

Although the present claims broadly cover multiple design options, they work in general as the specific example described herein.

It will be appreciated by the reader that the example described herein represents but one of many tool designs which may be constructed and which will accomplish the result claimed in this patent application in basically the same way—that being to rotate an auger using the kinetic energy of the sonde, and that the patent should be broadly construed to include any tool design that produces that specific result in the same basic manner and using the same basic energy transfer. For example, there are many designs of spiral or helical gears that might be used. Instead of a spring 60 in the upper portion, a fluid-filled pneumatic device 72 or other form of resistance might be employed. The auger nose 26 might be given any of multiple pitches and shapes as shown in FIG. 5; or the upper or lower casing and mud ports might be given different design or eliminated altogether.

ALTERNATE EMBODIMENTS

While only a single embodiment of the present invention has been illustrated and described herein, it is apparent that various modifications and changes may be made without departing from the principles of this invention in its broader aspects, and, therefore the aim in the appended claims is to cover such modifications and changes as fall within the spirit and scope of this invention.

Figure 4A:
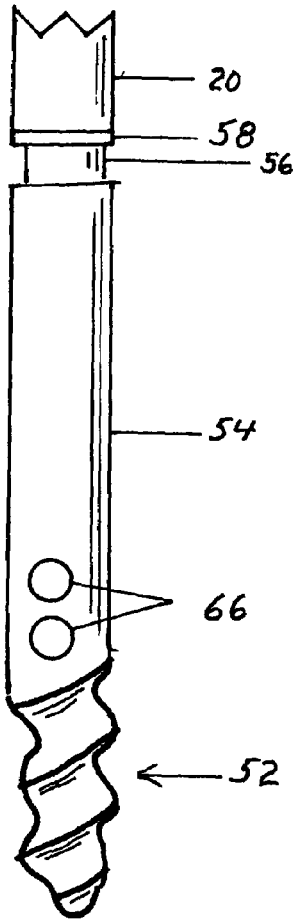
FIG. 4*a* shows an exterior view of the present invention in its collapsed position, attached to the lower end of a logging sonde.
Figure 4B:
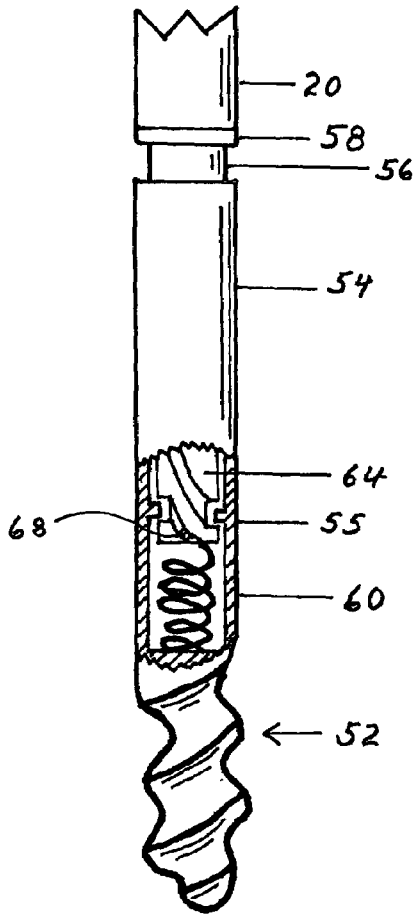
FIG. 4*b* shows a cut-away view of the present invention in its collapsed position, attached to the lower end of a logging sonde. The spiral gear and compressed spring are shown.
Figure 5A:
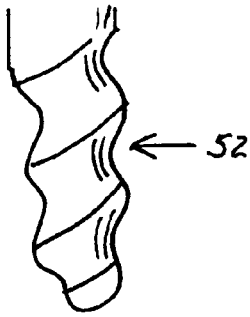
FIGS. 5*a*–5*f* show some of the many auger designs suggested as alternate embodiments of the present invention. The normal diameter of the logging sonde and the body of the present invention is normally around four inches; the length of the augers can be short, as shown these illustrations, or much longer.
Figure 5B:
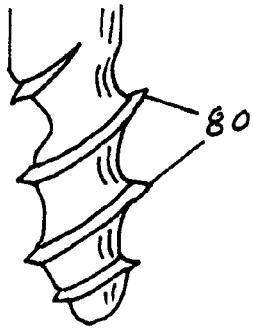
Figure 5C:
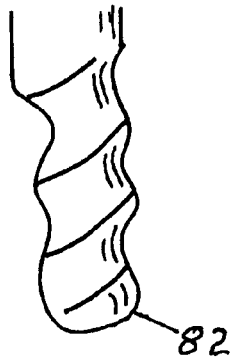
Figure 5D:
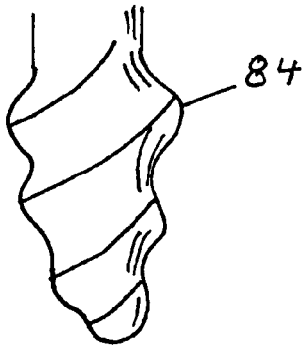
Figure 5E:
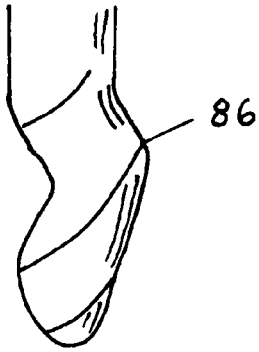
Figure 5F:
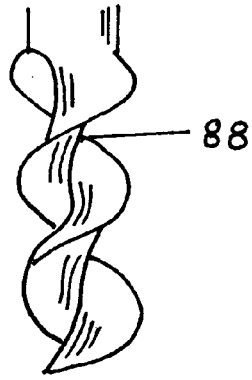
Figure 6A:
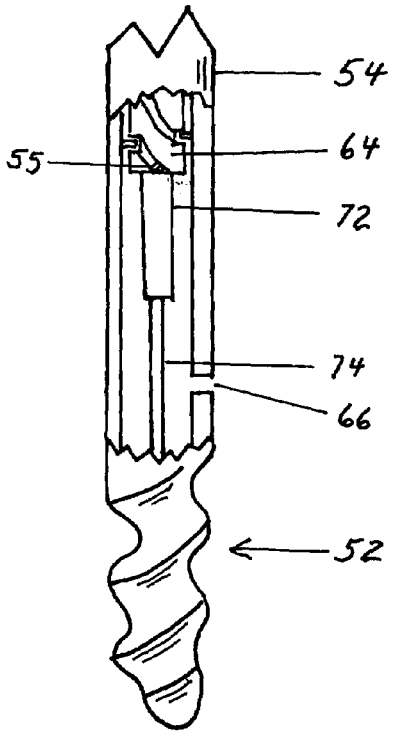
FIG. 6*a* is a cut-away view of an embodiment of the present invention in which a pneumatic device replaces the spring as the compression resistance.
Figure 6B:
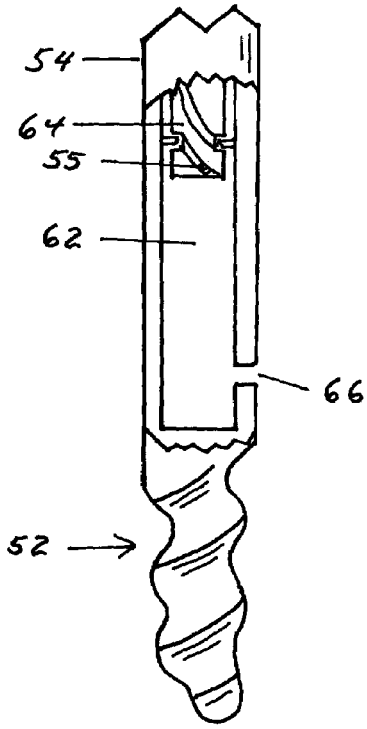
FIG. 6*b* is a cut-away view of an embodiment of the present invention in which only gravity is employed to keep the auger in extended position.

FIG. 5 illustrates a few of the many possible designs of the auger nose 25 of the present invention. Each may have its best use in specific situations, and this patent should not be construed as limited by auger design. In FIG. 4*a*, the spring resistance device 27 in the augering tool is replaced by a pneumatic resistance device comprising a cylinder 40 and piston 41, which could be constructed in numerous designs other than the one illustrated. The resistance devices depicted are standard mechanical products and are not claimed in this patent, but their function of storing kinetic energy as potential energy in the present invention is regarded as a new application that is claimed below. FIG. 4*b* shows the simplest design of the present invention, in which the force of gravity is utilized to return the auger to initial extended position. This technique may be effective in a vertical hole.

I claim:

1. An assembly for converting kinetic energy in a downward-moving borehole logging sonde to rotational energy in an augering device in order to urge said logging sonde to bypass sidewall obstructions while running in an earth borehole, comprising:

(a) the logging sonde;

(b) the augering device comprising:

(i) an augering tool;

(ii) a means of temporarily storing said kinetic energy as potential energy during the compression of said angering tool by said sidewall obstruction; and (iii) a spiral gear assembly;

(c) a means of connecting said augering device to the bottom, leading end of said logging sonde, and (d) a means of connecting said augering tool, said spring, and said spiral gear together as the augering device, with said augering tool being placed at the bottom end of the augering device such that upon striking any of said sidewall obstructions, said augering tool is pushed rearward along said spiral gear and against the means for storing kinetic energy as potential energy, thereby inducing said augering tool to rotate using kinetic energy thus transferred from the downward momentum of said logging sonde, in such a manner so as to pull said downward-moving logging sonde past said sidewall obstruction, whereby said stored potential energy subsequently urges said augering tool to return to its initial extended position after said sidewall obstruction has been bypassed and resisting force on said augering tool has lessened.

2. The apparatus of claim 1 in which said apparatus relies on a pneumatic device to store said kinetic energy as potential energy and to return said angering tool to its initial extended position.

3. The apparatus of claim 1 in which said augering tool relies on the force of gravity to store said kinetic energy as potential energy and to return said augering tool toward its initial extended position.

4. The apparatus of claim 1 in which said augering tool relies on an electromagnetic device to store said kinetic energy as potential energy and to return said augering tool toward its initial extended position.

5. The apparatus of claim 1 in which said augering tool relies on a spring to store said kinetic energy as potential energy and to return said augering tool to its initial extended position.

6. The apparatus of any one of claims 1 to 5 that can be attached to the downhole end of a pipe that is being run into said borehole.

7. The apparatus of any one of claims 1 to 5 that can be attached to the downhole end of a rod that is being run into said borehole.

8. A method of conveying a borehole logging sonde past sidewall obstructions during a running-in-hole operation, comprising:

(a) providing the augering device of claim 1 and connecting it to the downhole end of said logging sonde, (b) running-in-hole with said logging sonde, (c) upon striking any of said sidewall obstructions, permitting said augering tool to compress and travel rearward along said spiral gear, thereby rotating, (d) thereby allowing said rotating augering tool to change the shape and orientation of the leading end of said logging sonde that has struck said sidewall obstruction and to urge said logging sonde past said borehole obstruction by means of an augering action, (e) allowing said augering tool to simultaneously compress said means for storing kinetic energy as potential energy, thereby storing potential energy in said augering tool, and (f) allowing said augering tool to utilize said stored potential energy to return toward its initial extended position after said obstruction has been passed and the resisting force has lessened.

9. The method of claim 8 wherein the item being run in the borehole is a pipe.

10. The method of claim 8 wherein the item being run in the borehole is a rod.

* * * * *